US009741274B1

(12) United States Patent
Elmer

(10) Patent No.: US 9,741,274 B1
(45) Date of Patent: Aug. 22, 2017

(54) VEHICLE MOUNTED SIGN ASSEMBLY AND RELATED METHODS

(71) Applicant: Steven W. Elmer, Winter Park, FL (US)

(72) Inventor: Steven W. Elmer, Winter Park, FL (US)

( * ) Notice: Subject to any disclaimer, the term of this patent is extended or adjusted under 35 U.S.C. 154(b) by 0 days.

(21) Appl. No.: 15/230,710

(22) Filed: Aug. 8, 2016

Related U.S. Application Data

(60) Provisional application No. 62/201,880, filed on Aug. 6, 2015.

(51) Int. Cl.
*G09F 21/04* (2006.01)
*G09F 7/20* (2006.01)
*G09F 7/18* (2006.01)

(52) U.S. Cl.
CPC ..... *G09F 21/048* (2013.01); *G09F 7/20* (2013.01); *G09F 2007/1834* (2013.01); *G09F 2007/1852* (2013.01); *G09F 2007/1865* (2013.01)

(58) Field of Classification Search
CPC . G09F 21/04; G09F 17/00; G09F 7/12; G09F 2017/0075; G09F 21/048; G09F 7/18
USPC ..... 40/491
See application file for complete search history.

(56) References Cited

U.S. PATENT DOCUMENTS 4,231,501 A * 11/1980 Goode ..... B60R 9/12 211/70.5
5,084,994 A * 2/1992 Elmer ..... G09F 21/04 40/591
5,210,970 A * 5/1993 Elmer ..... G09F 21/04 40/591
5,230,173 A * 7/1993 Riley ..... B42F 17/02 40/404
5,339,551 A * 8/1994 Elmer ..... G09F 21/04 40/591
5,692,331 A * 12/1997 Tipke ..... G09F 21/04 248/205.6
7,066,105 B2 * 6/2006 Tal ..... B60Q 1/50 116/173
7,069,679 B2 * 7/2006 Haggard, Jr. ..... G09F 7/12 40/591
2005/0252053 A1 * 11/2005 Pena ..... G09F 21/04 40/591
2007/0193093 A1 * 8/2007 Taylor ..... G09F 21/04 40/643

(Continued)

*Primary Examiner* — Shin Kim
(74) *Attorney, Agent, or Firm* — Allen Dyer Doppelt & Gilchrist

(57) ABSTRACT

A vehicle mounted sign assembly comprises a base member having a top surface, a bottom surface, a leading edge, a trailing edge and side surfaces between the leading edges and the trailing edge, with the side surfaces tapering rearwardly to the trailing edge. The assembly further comprises a mounting assembly configured to support the base member. The mounting assembly comprises a first and a second vertical bars extending through respective openings on the bottom surface of the base member, a first and a second horizontal bars mounted in parallel and positioned between the first and second vertical bars, and a first and a second suction cups attached to respective bottom end of the first and second vertical bars for attachment to the body or a window of a vehicle.

20 Claims, 6 Drawing Sheets

(56) References Cited

U.S. PATENT DOCUMENTS

| | | | | |
|---|---|---|---|---|
| 2007/0277412 | A1* | 12/2007 | Haubert | G09F 21/04 40/593 |
| 2009/0064552 | A1* | 3/2009 | Columbia | B60R 13/10 40/591 |
| 2010/0192432 | A1* | 8/2010 | Pereira | G09F 21/04 40/212 |

* cited by examiner

VEHICLE MOUNTED SIGN ASSEMBLY AND RELATED METHODS

CROSS-REFERENCE TO RELATED APPLICATION

This application claims the benefit of U.S. Provisional Patent Application Ser. No. 62/201,880, filed on Aug. 6, 2015, the contents of which are herein incorporated by reference in their entirety.

FIELD OF THE INVENTION

The present invention relates to the field of vehicle-mounted signs, and particularly to signs and message boards that are suitable for repeated mounting upon and removal from a motor vehicle.

BACKGROUND OF THE INVENTION

A variety of businesses, particularly in the fast food industry, employ part-time delivery vehicles. Typically, a business of this type will provide a sign that can be mounted on a part-time delivery person's own vehicle and removed at the end of that person's shift for use during a subsequent next shift. Such signs are usually mounted on the window or roof of delivery vehicles. There is a need for a vehicle mounted sign assembly design that could increase the effectiveness and security of attachment of advertising signs to any type of vehicles.

SUMMARY OF THE INVENTION

In view of the foregoing, it is an object of the present invention to provide an improved vehicle mounted sign assembly and related methods of use. According to one embodiment of the present invention, a vehicle mounted sign assembly comprises a base member having a top surface, a bottom surface, a leading edge, a trailing edge and side surfaces between the leading edges and the trailing edge, with the side surfaces tapering rearwardly to the trailing edge. The assembly further comprises a mounting assembly configured to support the base member. The mounting assembly comprises a first and a second vertical bars extending through respective openings on the bottom surface of the base member, a first and a second horizontal bars mounted in parallel and positioned between the first and second vertical bars, and a first and a second suction cups attached to respective bottom end of the first and second vertical bars for attachment to the body or a window of a vehicle. The mounting assembly can further comprise at least one window mounting clip mounted on the second horizontal bar and adapted to be positioned on a top rim of the window of the vehicle.

These and other objects, aspects and advantages of the present invention will be better appreciated in view of the drawings and following detailed description of preferred embodiments.

DETAILED DESCRIPTION OF PREFERRED EMBODIMENTS

Figure 1:
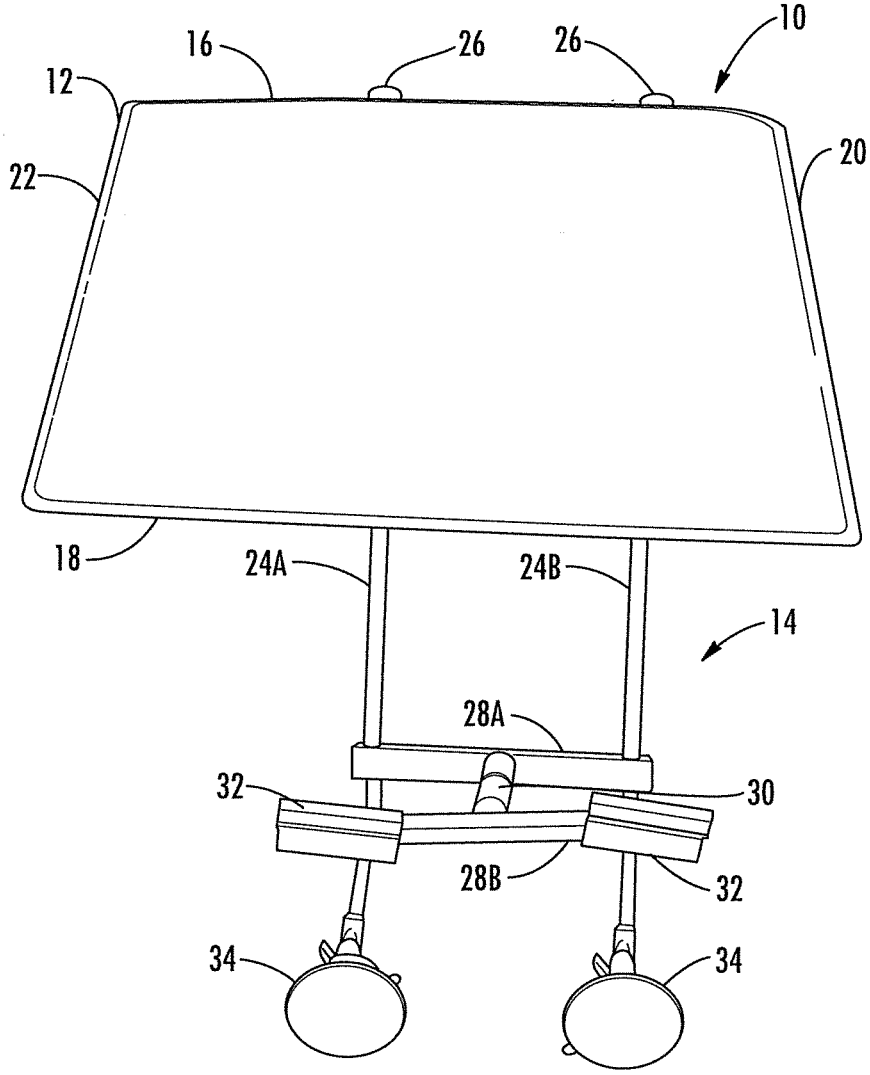
FIG. 1 is a side view of a vehicle mounted sign assembly according to an embodiment of the present invention.
Figure 2:
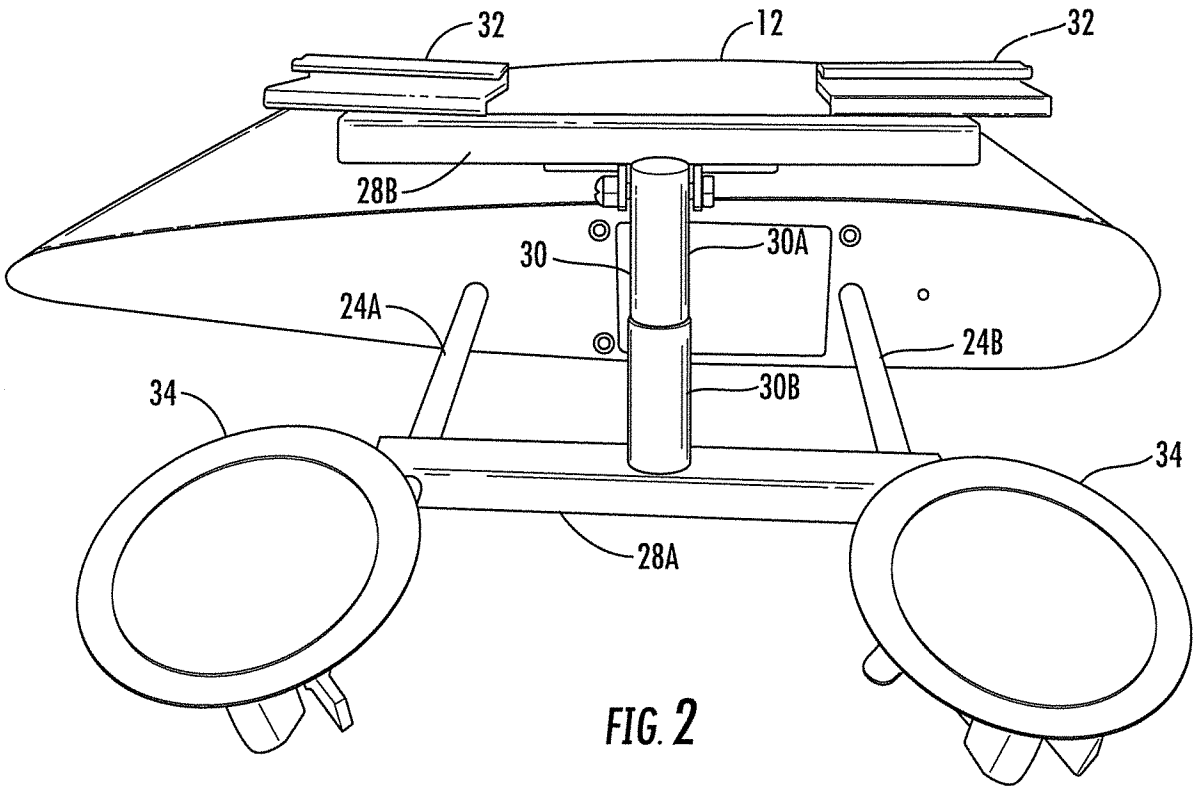
FIG. 2 is a bottom view of a vehicle mounted sign assembly of FIG. 1 according to an embodiment of the present invention.
Figure 3:
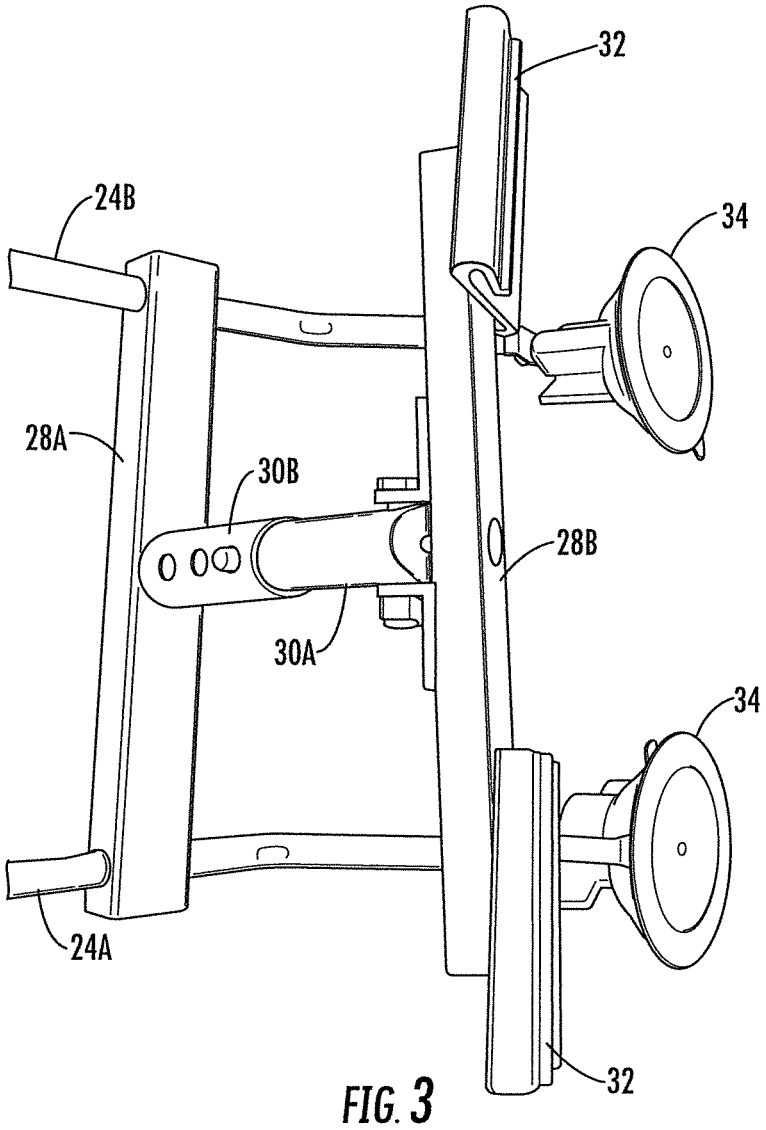
FIG. 3 is a perspective view of the mounting assembly of the vehicle mounted sign assembly of FIG. 1.
Figure 4:
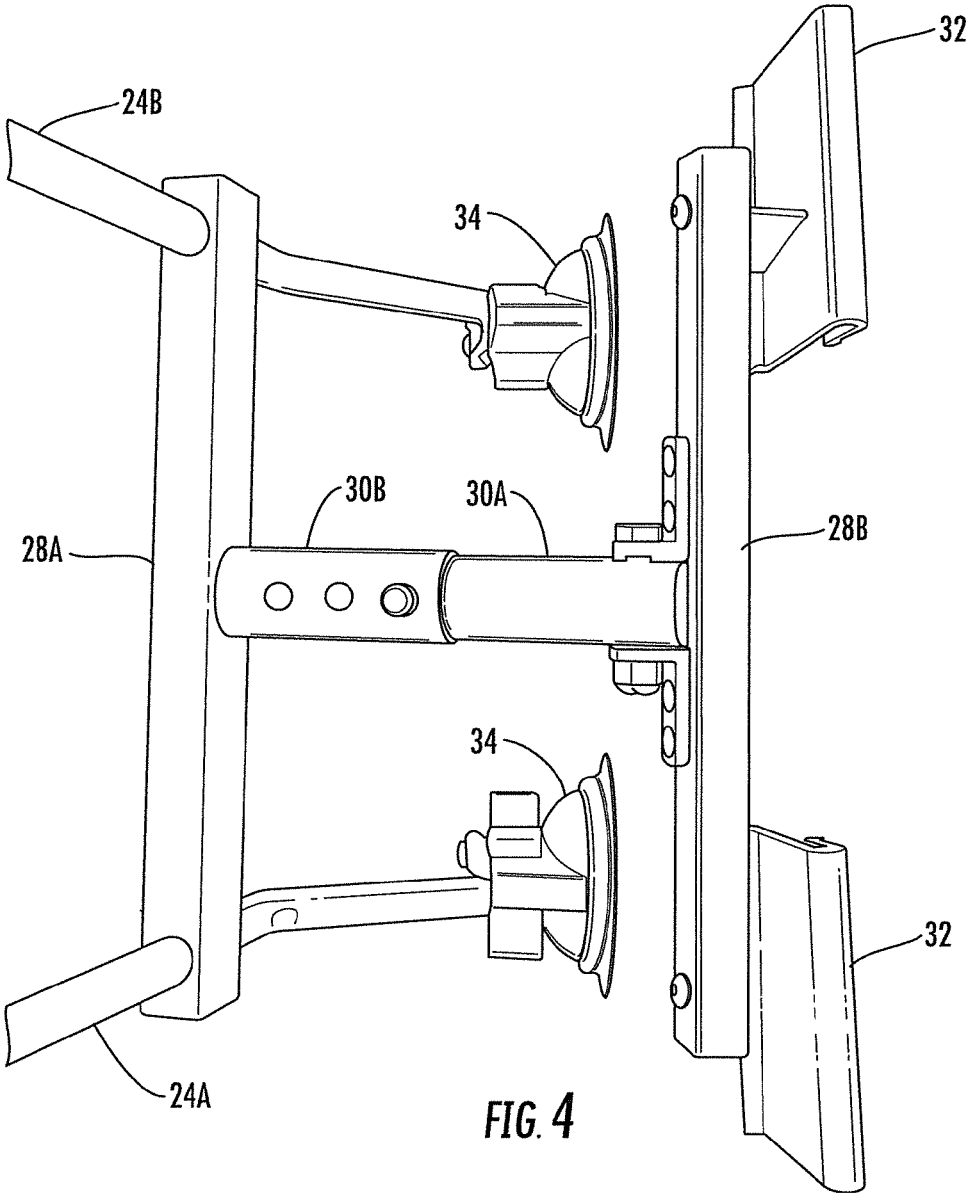
FIG. 4 is another perspective view of the mounting assembly of the vehicle mounted sign assembly of FIG. 1.

Referring to FIGS. 1-4, a vehicle mounted sign assembly 10, according to an embodiment of the present invention, includes a base member 12 supported upon a mounting assembly 14. In one embodiment, the base member 12 is an enclosed hollow, aerodynamic structure having a top surface 16, a bottom surface 18, a curved leading edge 20, a curved trailing edge 22 and side surfaces between the edges 20 and 22, with the side surfaces tapering rearwardly to the trailing edge 22. In a preferred embodiment, the side surfaces curve outwardly. The base member 12 is made of rigid or semi-rigid materials, and the aerodynamics of its configuration provide a minimum of wind drag when mounted upon a vehicle. A sign or message board can be attached to the outer surface of the base member 12 via mechanical fasteners, adhesive or other appropriate attachment methods.

The mounting assembly 14 includes a first and second vertical bars 24A and 24B, which extend through respective openings on the bottom surface 18 of the base member 12. The first and second vertical bars can pass through the base member 12 and attached to the top surface 16 of the base member 12 via fasteners 26. The fasteners 26 can also facilitate the securing of an advertising sign attached to the side surfaces of the base member 12. The mounting assembly 14 further comprises a first and second horizontal bars 28A and 28B mounted in parallel. The horizontal bar 28A is positioned between the first and second vertical bars 24A and 24B. The second horizontal bar 28B is connected to the first horizontal bar 28A via a length-adjustable third horizontal bar 30, which is perpendicular to the first and second horizontal bars 28A and 28B. The third horizontal bar 30 is rigidly attached to the center of the first and second horizontal bars 28A and 28B. The third horizontal bar 30 includes a stem 30A inserted into a sleeve 30B. The stem 30A can move in and out of the sleeve 30B between an extended position and a retracted position. The stem 30A and the sleeve 30B each includes a plurality of locking holes, in which a locking bar (e.g., a block, a screw, etc.) can be positioned for securing the stem 30A and sleeve 30B in a desired position. The extended position corresponds to the longest distance between the first and second horizontal bars 28A and 28B. The retracted position corresponds to the shortest distance between the first and second horizontal bars 28A and 28B.

Figure 5:
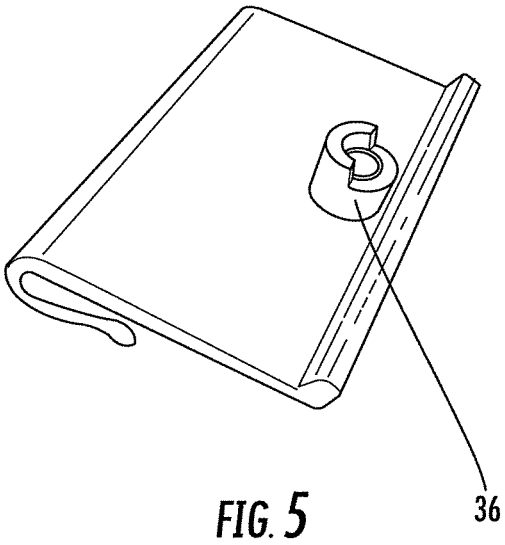
FIG. 5 is a perspective view of a window clip of the vehicle mounted sign assembly of FIG. 1.

At least one window mounting clip 32 can be mounted on the second horizontal bar 28B to further secure the mounting assembly to a window of a vehicle. In the depicted embodiment, a pair of window mounting clips 32 is mounted to two ends of the horizontal bar 28B via a screw or other appropriate mechanical connection means. When the vehicle-mounted sign assembly 10 is mounted on a side window of a vehicle, the pair of window mounting clips 32 is positioned on the top rim of the window glass. The pair of window mounting clips 32 can have certain degree rotational flexibility so as to permit the mounting assembly 14 to be firmly secured on the different types of vehicle window. In one embodiment, rotational flexibility can be achieved by having a protruding bottom half circle surrounding a screw socket 36 as shown in FIG. 5. The protruding bottom circle can allow the pair of window mounting slips 32 to rotate about 45 degrees on each direction without lateral displacement.

A pair of removable suction cups 34 is attached to the bottom ends of the first and second vertical bars 24A and 24B for attachment to the body or a window of a vehicle. The bottom ends of the first and second vertical bars 24A and 24B bend toward the direction of the horizontal bar 28B in such a way that the pair of suction cups 34 can be mounted generally in parallel with the longitudinal dimension of the base member 10, thus making the leading edge of the base member 12 face in the direction of vehicle travel when the vehicle-mounted sign assembly 10 is mounted on a vehicle side window.

The base member 12 is preferably formed of a plastic material, such as plexiglass, polycarbonate, or the like. In a preferred embodiment, the base member 12 is a unitary member made of a molded plastic sheet. The mounting assembly 14 is formed of metal, plastic, polyethylene, or another suitable material and/or combination thereof.

Figure 6:
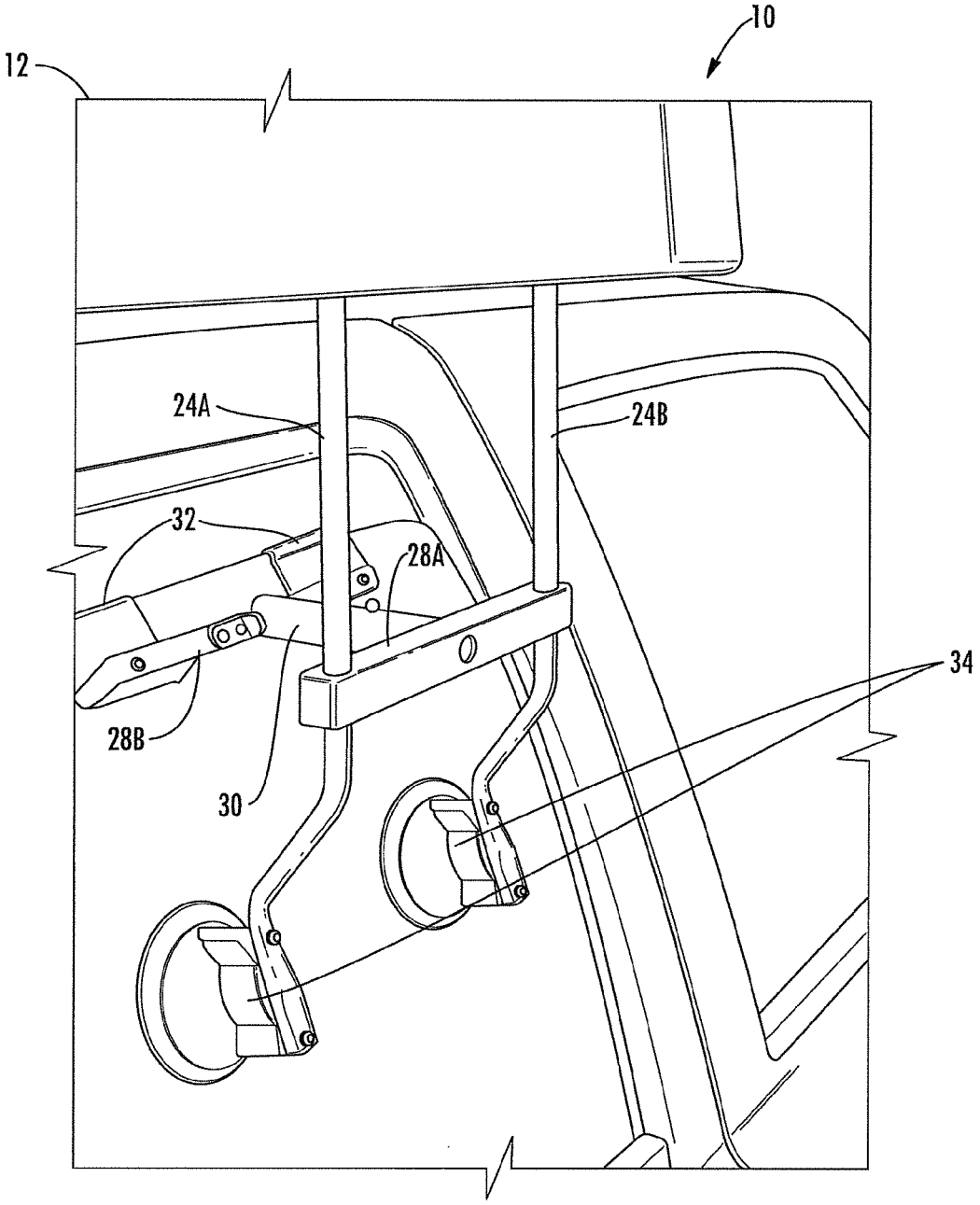
FIG. 6 is a perspective view of the vehicle mounted sign assembly of FIG. 1 mounted on a vehicle.

Referring to FIG. 6, the vehicle-mounted sign assembly 10 is mounted on a vehicle. The pair of window mounting clips 32 is positioned on the top rim of a vehicle window while the two suction cups 34 are positioned on the side of the same vehicle window. The vehicle window can be rolled up and down with the sign assembly 10 mounted thereon. The pair of window mounting clips 32 can be positioned in varying angles and slopes to accommodate the angle or slope of any vehicle window, and the distance between the two horizontal bars 28A and 28B can be adjusted via the horizontal bar 30 to ensure that the positions of the pair of window mounting clips 32 and the pair of suction cups 34 are coordinated and thus that position of the sign assembly 10 on the vehicle window is secure. The base member 12 can be maintained in an upright and presentable position independent of the slope and/or shape of the vehicle window to which it is mounted. The vehicle-mounted sign assembly 10 can be mounted securely on a plurality of window frame shapes without complex mechanical adjustment.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and the claims appended hereto.

What is claimed is:

1. A vehicle mounted sign assembly comprises:

a base member having a top surface, a bottom surface, a leading edge, a trailing edge and side surfaces between the leading edges and the trailing edge, with the side surfaces tapering rearwardly to the trailing edge; and a mounting assembly configured to support the base member; and wherein the mounting assembly comprises a first and a second vertical bars extending through at least one opening on the bottom surface of the base member;

a first and a second horizontal bars mounted in parallel and positioned between the first and second vertical bars; and a first and a second suction cups attached to respective bottom end of the first and second vertical bars for attachment to the body or a window of a vehicle.

2. The vehicle mounted sign assembly of claim 1, wherein the mounting assembly further comprises at least one window mounting clip mounted at the second horizontal bar.

3. The vehicle mounted sign assembly of claim 1, wherein the mounting assembly comprises a pair of window mounting clips mounted at two ends of the second horizontal bar.

4. The vehicle mounted sign assembly of claim 3, wherein the pair of window mounting clips are configured to be positioned on a top rim of the window of the vehicle.

5. The vehicle mounted sign assembly of claim 3, wherein the pair of window mounting clips have a certain degree rotational flexibility.

6. The vehicle mounted sign assembly of claim 5, wherein the rotational flexibility is achieved by having a screw socket surrounded by a protruding bottom half circle on each of the pair of window mounting clips.

7. The vehicle mounted sign assembly of claim 1, wherein a sign is attached to the outer surfaces of the base member.

8. The vehicle mounted sign assembly of claim 7, wherein the sign is attached to the outer surfaces of the base member via at least one mechanical fastener, adhesive, or a combination thereof.

9. The vehicle mounted sign assembly of claim 1, wherein the side surfaces curve outwardly.

10. The vehicle mounted sign assembly of claim 1, wherein the base member is made of rigid or semi-rigid materials.

11. The vehicle mounted sign assembly of claim 1, wherein the base member is made of plastic material.

12. The vehicle mounted sign assembly of claim 1, wherein the first and second vertical bars pass through the base member and attached to a top surface of the base member.

13. The vehicle mounted sign assembly of claim 1, wherein the first horizontal bar is connected to the second horizontal bar via a length-adjustable third horizontal bar perpendicular to the two horizontal bars.

14. The vehicle mounted sign assembly of claim 13, wherein the third horizontal bar is attached to respective centers of the first and second horizontal bars.

15. The vehicle mounted sign assembly of claim 13, wherein the third horizontal bar comprises a stem inserted into a sleeve, wherein the stem moves in and out of the sleeve between an extended position and a retracted position to adjust the distance between the first and the second horizontal bar.

16. The vehicle mounted sign assembly of claim 15, wherein the stem and the sleeve each includes a plurality of locking hole for a locking bar to be positioned for securing the stem and sleeve in a desired position.

17. A vehicle mounted sign assembly comprises:

a base member having a top surface, a bottom surface, a curved leading edge, a curved trailing edge and side surfaces between the leading edge and the trailing edge, with the side surfaces tapering rearwardly to the trailing edge;

a mounting assembly configured to support the base member;

wherein the mounting assembly comprises a first and a second vertical bars extending through at least one opening on a bottom surface of the base member;

a first and a second horizontal bars mounted in parallel and positioned between the first and second vertical bars; and a first and second suction cups attached to respective bottom ends of the first and second vertical bars for attachment to the body or a window of a vehicle; and at least one window mounting clip mounted the second horizontal bar.

18. The mounting assembly of claim 17, wherein the first horizontal bar is connected to the second horizontal bar via a length-adjustable third horizontal bar perpendicular to the first and second horizontal bars.

19. The mounting assembly of claim 18, wherein the third horizontal bar is attached to the center of the first and second horizontal bars.

20. The mounting assembly of claim 18, wherein the third horizontal bar comprises a stem inserted into a sleeve, wherein the stem moves in and out of the sleeve between an extended position and a retracted position.

* * * * *